US005280756A

United States Patent [19]

Labbe

[11] Patent Number: 5,280,756

[45] Date of Patent: Jan. 25, 1994

[54] $NO_x$ EMISSIONS ADVISOR AND AUTOMATION SYSTEM

[75] Inventor: Donald E. Labbe, Woburn, Mass.

[73] Assignee: Stone & Webster Engineering Corp., Boston, Mass.

[21] Appl. No.: 24,857

[22] Filed: Feb. 26, 1993

Related U.S. Application Data

[63] Continuation of Ser. No. 830,600, Feb. 4, 1992, abandoned.

[51] Int. Cl.[5] ..... F23N 5/22

[52] U.S. Cl. ..... 110/191; 110/185; 110/186; 110/190; 236/15 BA; 236/15 BD; 236/15 E; 431/14; 431/76

[58] Field of Search ..... 110/185, 186, 150, 191, 110/345; 236/15 BA, 15 BD, 15 E; 431/14, 76

[56] References Cited

U.S. PATENT DOCUMENTS

| | | | |
|---|---|---|---|
| 4,021,188 | 5/1977 | Yamagushi et al. . | |
| 4,257,763 | 3/1981 | Reed . | |
| 4,297,093 | 10/1981 | Morimoto et al. . | |
| 4,308,810 | 1/1982 | Taylor . | |
| 4,347,052 | 8/1982 | Reed et al. . | |
| 4,488,869 | 12/1984 | Voorheis . | |
| 4,528,918 | 7/1985 | Sato et al. . | |
| 4,572,110 | 2/1986 | Haeflich . | |
| 4,622,922 | 11/1986 | Miyagaki et al. | 110/185 X |
| 4,645,449 | 2/1987 | Schwartz et al. . | |
| 4,676,734 | 6/1987 | Foley | 110/186 X |
| 4,749,122 | 6/1988 | Shriver et al. | 236/15 BD |
| 4,996,951 | 3/1991 | Archer et al. | 122/379 |
| 5,009,210 | 4/1991 | Nakagawa et al. . | |
| 5,022,226 | 6/1991 | Bell . | |

OTHER PUBLICATIONS

Trivett, G. Michael, "$NO_x$ Reduction and Control Using an Expert System Advisor", Mar., 1991, Washington, D.C.

*Primary Examiner*—Edward G. Favors

*Attorney, Agent, or Firm*—Hedman, Gibson & Costigan

[57] ABSTRACT

A method and system for controlling and providing guidance in reducing the level of $NO_x$ emissions based on controllable combustion parameters and model calculations while maintaining satisfactory plant performance and not causing other harmful consequences to the furnace. To implement such a system, boiler control values of flow, pressure, temperature, valve and damper positions in addition to emission sensors for data associated with the production of $NO_x$, $O_2$, CO, unburned carbon and fuel. This information is received from standard sensors located throughout a boiler which are connected either to a distributed control system (DCS), or another data acquisition system which is time coordinated with the DCS. The DCS passes this information to a computing device which then processes the information by model based optimization simulation programs, also referred to as the $NO_x$ Emissions Advisor. The presentation of recommendations to the operator consists of a series of graphic displays hierarchically arranged to present the operator with a simple summary that has available more detail support displays at lower levels. The $NO_x$ emissions automation system transmits the recommended positions to the controlling devices including furnace air dampers and coal feeders.

15 Claims, 8 Drawing Sheets

$NO_X$ ADVISOR RECOMMEDATIONS

| PARAMETER | CURRENT STATUS | RECOMMENDATION |
|---|---|---|
| FEEDER A | ON | OFF |
| AUX AIR DMP | | |
| AA | 95% | 85% |
| AB | 85% | 75% |
| BC | 45% | 50% |
| CD | 35% | 45% |
| DI | 40% | 45% |
| EF | 50% | 55% |
| FF | 45% | N/C |
| FUEL AIR | | |
| A | 100% | 75% |
| B | 50% | 55% |
| C | 40% | 45% |
| D | 55% | 60% |
| E | 50% | N/C |
| F | 50% | 60% |

$NO_x$ EMISSIONS ADVISOR AND AUTOMATION SYSTEM

This is a continuation of co-pending application Ser. No. 07/830,600 filed on Feb. 4, 1992 abandoned.

FIELD OF THE INVENTION

The present invention relates to a system that monitors and analyzes the emissions from a boiler and advises on adjustments to controllable parameters in the boiler in order to minimize the amount of $NO_x$ emissions produced at the point of combustion, while maintaining proper plant performance.

BACKGROUND OF THE INVENTION

Recent Clean Air Act legislation mandates conformance to emission standards for $SO_2$ and $NO_x$. While $SO_2$ emissions can be controlled through flue gas desulfurization processes, the most cost effective technique to reduce $NO_x$ emissions is to limit the $NO_x$ production at the time of combustion.

The formation of $NO_x$ is highly sensitive to the combustion process. $NO_x$ can be formed by the process of thermal fixation of atmospheric nitrogen, known as thermal $NO_x$; and by the conversion of chemically bound nitrogen within the coal, known as fuel $NO_x$. Through experimentation, the formation of thermal $NO_x$ has been found to be highly temperature dependent. For example, one correlation indicates that above a threshold temperature of approximately 2800° F., with sufficient oxygen present the rate of formation of thermal $NO_x$ doubles every 70° F. Fuel $NO_x$ does not indicate a strong temperature dependence. The conversion of nitrogen in the fuel to $NO_x$ is the preferred reaction in the presence of sufficient oxygen. For coals in the United States, the nitrogen content typically ranges form 0.6 to 1.8% by weight. These high percentages generally result in fuel $NO_x$ as the primary source of $NO_x$ emissions.

The generally accepted techniques to reduce $NO_x$ formation are to reduce peak firing temperatures through the spreading of the flame and to reduce the available oxygen at the primary combustion sites. Attempts to spread the flame and reduce oxygen can have severe consequences, however, such as an increase in the amount of unburned carbon in the ash; an increase in the amount of CO emissions; increased difficulty in positioning flame scanners, thereby preventing the scanners from properly observing the flame; a reducing environment within the furnace, which promotes the corrosion of boiler components; a change in the fouling characteristics of the furnace, possibly resulting in slag formation, making it more difficult to properly clean the surfaces; and a reduction in plant performance through lower steam generation and/or higher flue gas losses.

Other combustion techniques for suppressing the generation of $NO_x$ are two-staged combustion, flue gas recirculation, reduced excess air, and sub-stoichiometric combustion. Recently, some power plants have been upgraded and retrofitted with new combustion hardware such as low $NO_x$ burners, increased cooling area of the furnace and overfire air to help reduce the levels of $NO_x$ emissions; however, some of the same serious consequences discussed above have resulted. The potential severity of these consequences on the efficiency and availability of the unit mandate that the changes undertaken to reduce $NO_x$ properly weigh these effects.

Emissions data from actual coal fired power plant testing has shown that $NO_x$ formation is strongly influenced by controllable parameters including coal flow, burners in service, inlet air temperatures, inlet air flow patterns, air staging, firing patterns, excess air levels, flue gas recirculation and others. This data indicates that the interactions leading to $NO_x$ production are complex, and that achieving the lowest possible $NO_x$ production levels without undue loss of performance or stress on equipment is complex.

SUMMARY OF THE INVENTION

It is an object of the present invention to provide a model based optimization program to facilitate efficient reduction of $NO_x$ emission levels produced by a boiler unit while maintaining the efficiency of the unit cycle. The program determines which controllable combustion parameters can be adjusted in order to reduce the level of $NO_x$ emissions being produced and quantifies the effect on both $NO_x$ production and efficiency resulting from various adjustments. The system monitors various sensor inputs and provides guidance to the boiler operator regarding the necessary adjustments to the controllable combustion parameters during and following load changes, upset conditions and equipment failures in order to reduce the level of $NO_x$ emissions. The guidance is based on weighted considerations of benefits and consequences of possible changes, including the gradual deterioration of combustion hardware.

The system can operate in two modes; Advisor or Controller, to determine the setting, position, or value for the appropriate controllable combustion parameters which attain minimal $NO_x$ production. This information is then provided to the operator for guidance. The "Advisor" mode calculates the effect that the modification of particular controllable combustion parameters will have on the amount of $NO_x$ emissions produced using a model of the process. This mode assigns a weight factor to each effect that would occur as a result of the current settings of the furnace. Based on these factors, the model then performs a number of calculations to determine the optimum setting for the controllable parameters which would result in the least amount of $NO_x$ emissions while maintaining satisfactory operation of the furnace. The presentation of recommendations to the operator consists of a series of graphic displays hierarchically arranged to present the operator with a simple summary which has more detailed support displays available at lower levels. The "Controller" mode automatically regulates the controllable parameters following operator confirmation (semi-automatic) or without operator intervention (fully automatic).

The program uses as inputs conventional measurements of flow, pressure, temperature, valve and damper positions in addition to emission sensors for data associated with the production of $NO_x$, $O_2$, CO, unburned carbon and fuel. This information is received from standard sensors located throughout a boiler which are connected to either a distributed control system (DCS), or to another data acquisition system which is time coordinated with the DCS. The DCS passes this information to a computing device, which then processes the information in simulation models.

BRIEF DESCRIPTION OF THE DRAWING

The present invention will be better understood when considered with the accompanying drawings wherein.

DETAILED DESCRIPTION OF THE INVENTION

Figure 1:
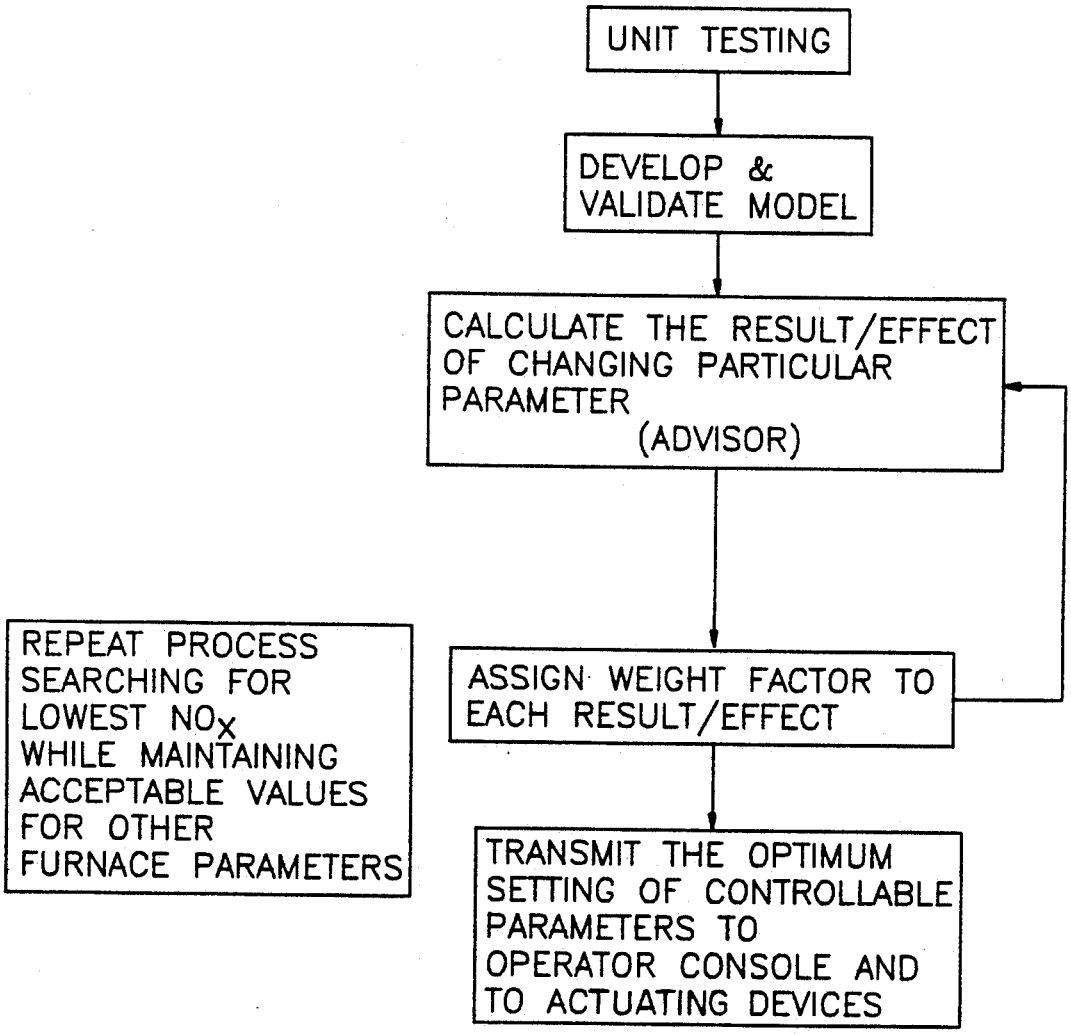
FIG. 1 is a flow chart of the operation of the $NO_x$ advisor system.

The principle behind this invention is to make use of available combustion controllable parameter information to control and reduce the level of $NO_x$ emissions while maintaining satisfactory plant performance and not causing other harmful consequences. As illustrated in FIG. 1, the first step of this system is unit testing. In this step, a determination is made of which combustion controllable parameters influence the production of $NO_x$ emission and the degree to which those combustion controllable parameters can reduce the level of $NO_x$ emissions. This information is then used to customize and validate a model which predicts the level of $NO_x$ emissions which are produced as a result of varying the combustion controllable parameters in the particular furnace under test. The model is a combination of optimization and simulation programs which analyze actual system conditions and determine the necessary changes to combustion controllable parameters which will reduce the level of $NO_x$ emissions.

The model has the ability to function as an "Advisor" or as a "Controller". Functioning as an Advisor, the model calculates the effect that modifying a particular controllable combustion parameter will have on the amount of $NO_x$ emissions produced and assigns a weight factor to each effect that occurs as a result of the current settings of the furnace. Based on these factors, the model then performs a number of calculations to determine the optimum setting for the controllable parameters which result in the least amount of $NO_x$ emissions and the maximum efficiency for the furnace. This information is presented to the boiler operator in a series of graphic displays hierarchically arranged, with a simple summary which is followed by more detailed support displays. Functioning as a Controller System, the model automatically activates controls which vary the controllable combustion parameters through the DCS, or other type of control system.

Figure 2:
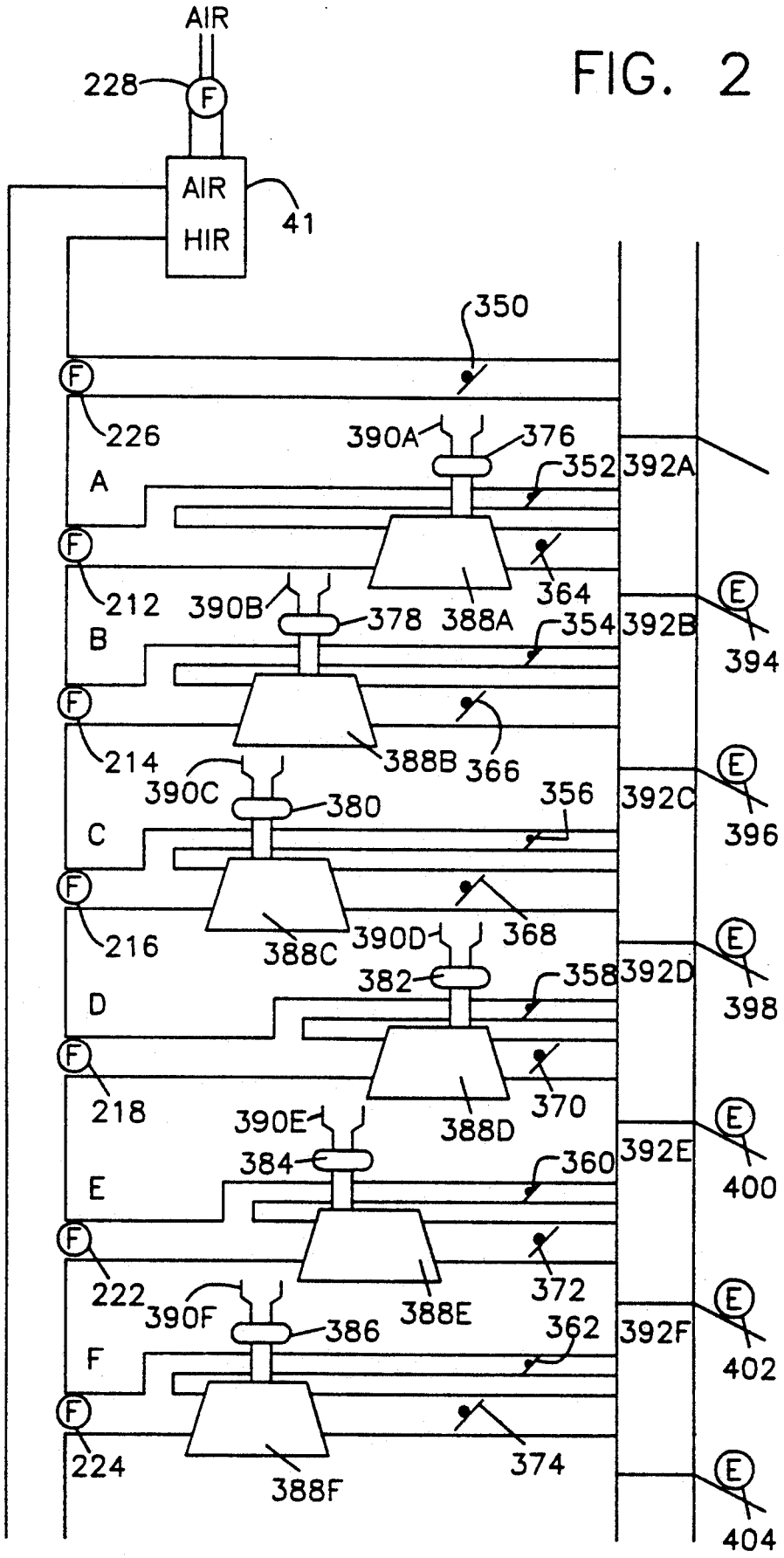
FIG. 2 is a schematic of the coal feeder section of a coal-fired boiler system.
Figure 3A:
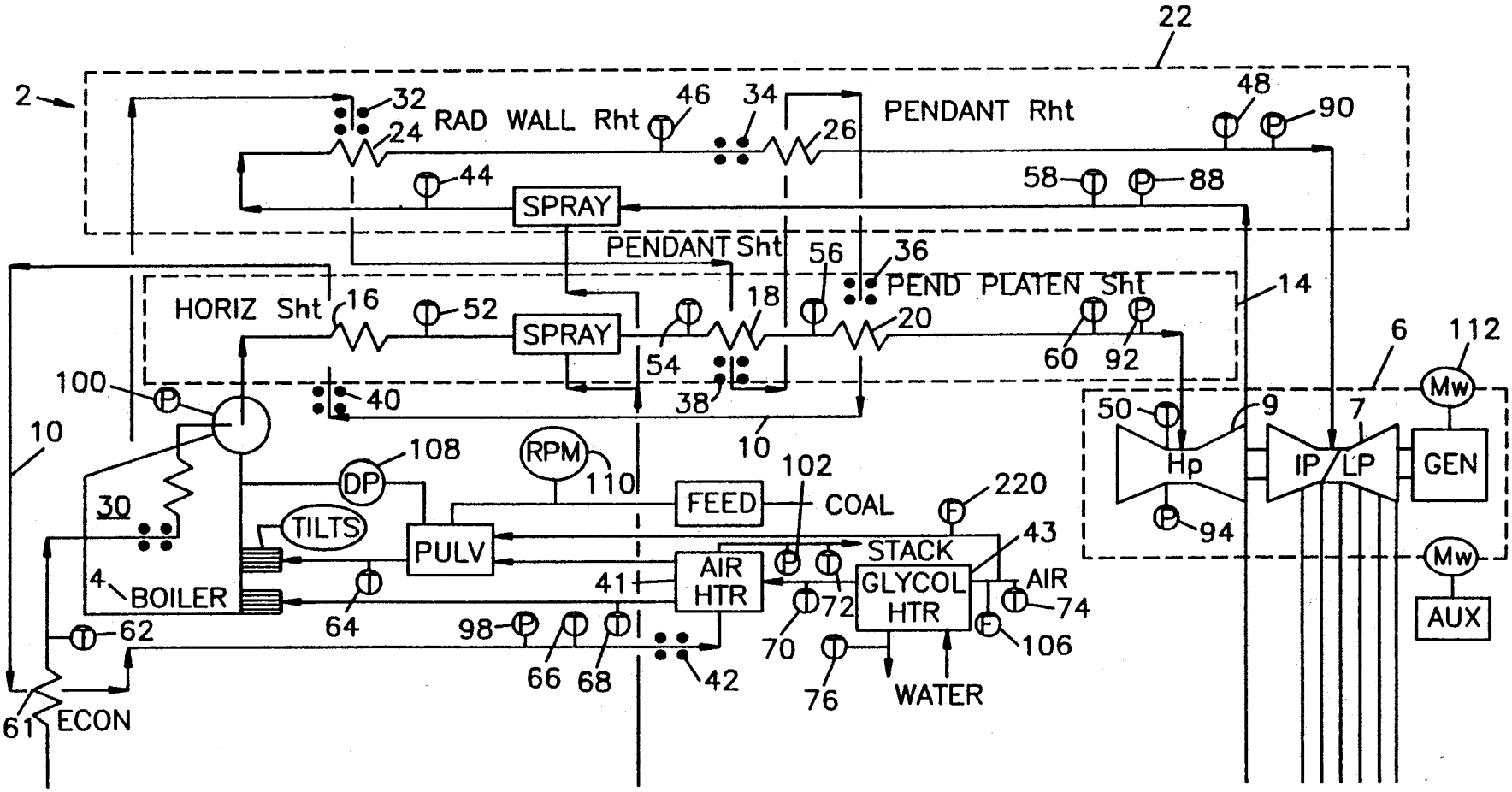
FIGS. 3(*a*) and 3(*b*) are a schematic of a boiler system.
Figure 3B:
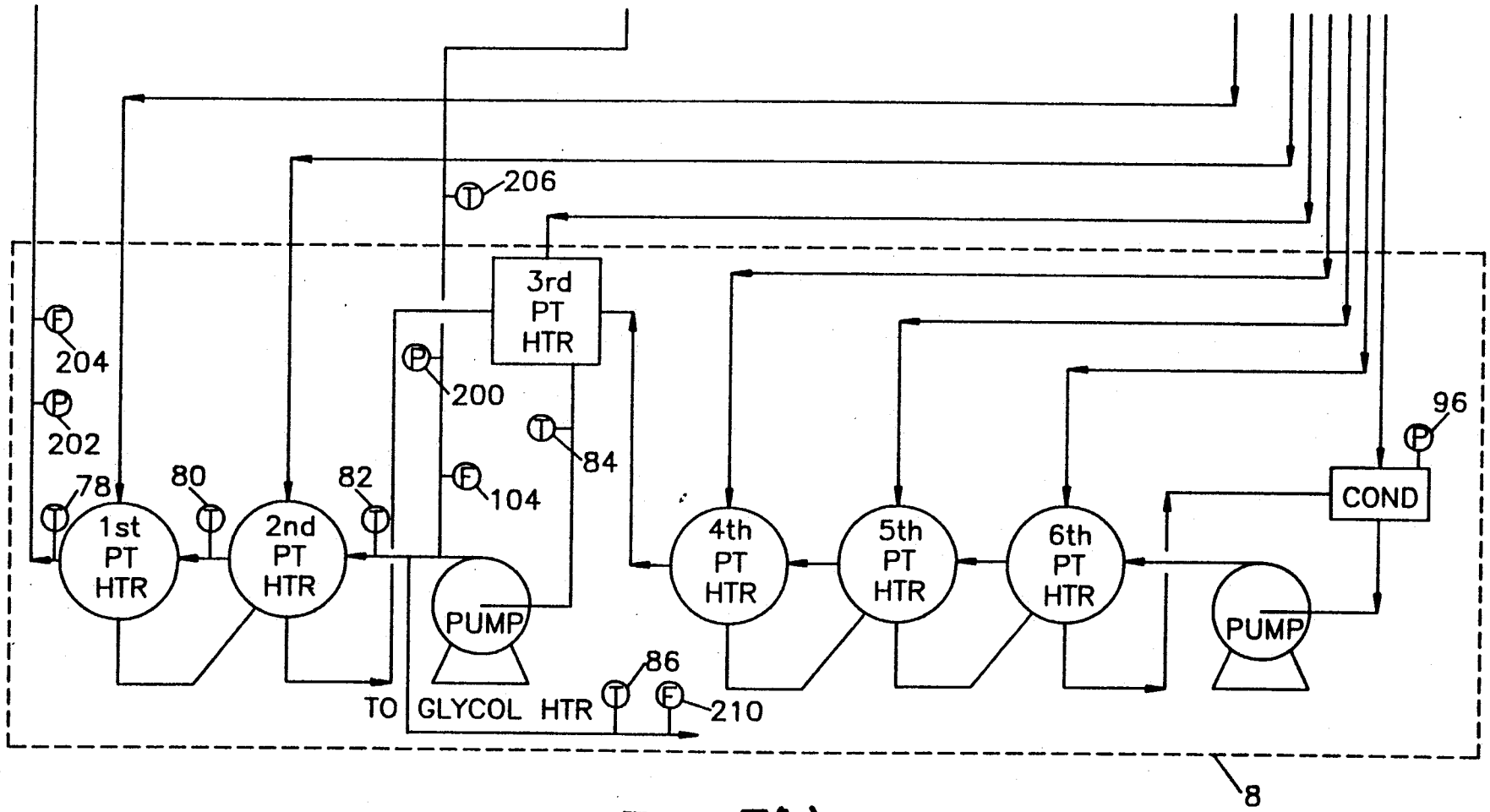

The present invention is described in the environment of a coal fired boiler system 2 as illustrated in FIGS. 2, 3(*a*) and 3(*b*). The system 2 is comprised of a boiler 4 having a plurality of levels. Illustratively there are shown six vertical levels, A–F, in the furnace with level A being the top and level F being the bottom. The coal used to fire the boiler 4 is stored in coal bunkers 390A, 390B, 390C, 390D, 390E and 390F and is fed to the mills 388A, 388B, 388C, 388D, 388E and 388F by means of variable speed coal feeders 376, 378, 380, 382, 384 and 386. The coal is pulverized in the mills 388A, 388B, 388C, 388D, 388E and 388F and then supplied to the burners 392A, 392B, 392C, 392D, 392E and 392F. Hot air flowing through the mills 388A, 388B, 388C, 388D, 388E and 388F dry the coal powder and carry the powder to the burners 392A, 392B, 392C, 392D, 392E and 392F through fuel air dampers 364, 366, 368, 370, 372 and 374 to carry the pulverized coal. Additional air is directed into the burners 392A, 392B, 392C, 392D, 392E and 392F for the combustion of the coal via auxiliary air dampers, 352, 354, 356, 358, 360 and 362. Hot air flowing through the mills 388A, 388B, 388C, 388D, 388E and 388F dry the coal powder and carry the powder to the boiler 4 through fuel air ports located at the corners of the boiler 4. Each mill 388A, 388B, 388C, 388D, 388E and 388F provides fuel at one level of the boiler 4 providing a means to regulate fuel distribution in the boiler 4.

The hot air carrying the coal powder does not generally contain sufficient oxygen to fully combust the coal. Additional combustion air is provided through auxiliary air ports to complete combustion. Auxiliary air ports are located at the furnace corners above each fuel air port. Air may also be provided several feet above the highest fuel air port through an over-fire air port 350.

The air flow distribution through the fuel air ports, auxiliary air ports and over-fire air ports are regulated by individual dampers. Dampers are typically positioned by a pneumatic control positioner. The damper position demand signal is provided by a control system. At each level there are fuel air dampers 364, 366, 368, 370, 372 and 374; and auxiliary air dampers 352, 354, 356, 358, 360 and 362. Thus, in this example, there are 6 auxiliary air dampers, 1 over-fire air damper, 6 fuel air dampers, and the 6 aforementioned fuel feeders. The auxiliary air dampers 352, 354, 356, 358, 360 and 362 feed air just above the fuel air dampers 364, 366, 368, 370, 372 and 374 and the over-fire air damper 350 feeds air well above the highest fuel air damper 364. Each level of auxiliary air dampers has its own controller. The dampers act to control the demand for more or less air at a particular level. The fuel air dampers 364, 366, 368, 370, 372 and 374, over-fire air damper 350, and auxiliary air dampers 352, 354, 356, 358, 360 and 362 are all strategically placed in the system.

There are also sensors that measure the temperatures, pressures, flows and emissions. Temperature sensors 44, 46, 48, 50, 52, 54, 56, 58, 60, 62, 64, 66, 68, 70, 72, 74, 76, 78, 80, 82, 84, 86 and 206 are strategically located in the system. Pressure sensors 88, 90, 92, 94, 96, 98, 100, 102, 200 and 202, flow sensors 104, 106, 108, 110, 204, 210, 212, 214, 216, 218, 220, 222, 224, 226 and 228, emission sensors 394, 396, 398, 400, 402 and 404 are also located strategically in the system. A generated power sensor 112 measures the mega-watts generated by the system generator.

Figure 4:
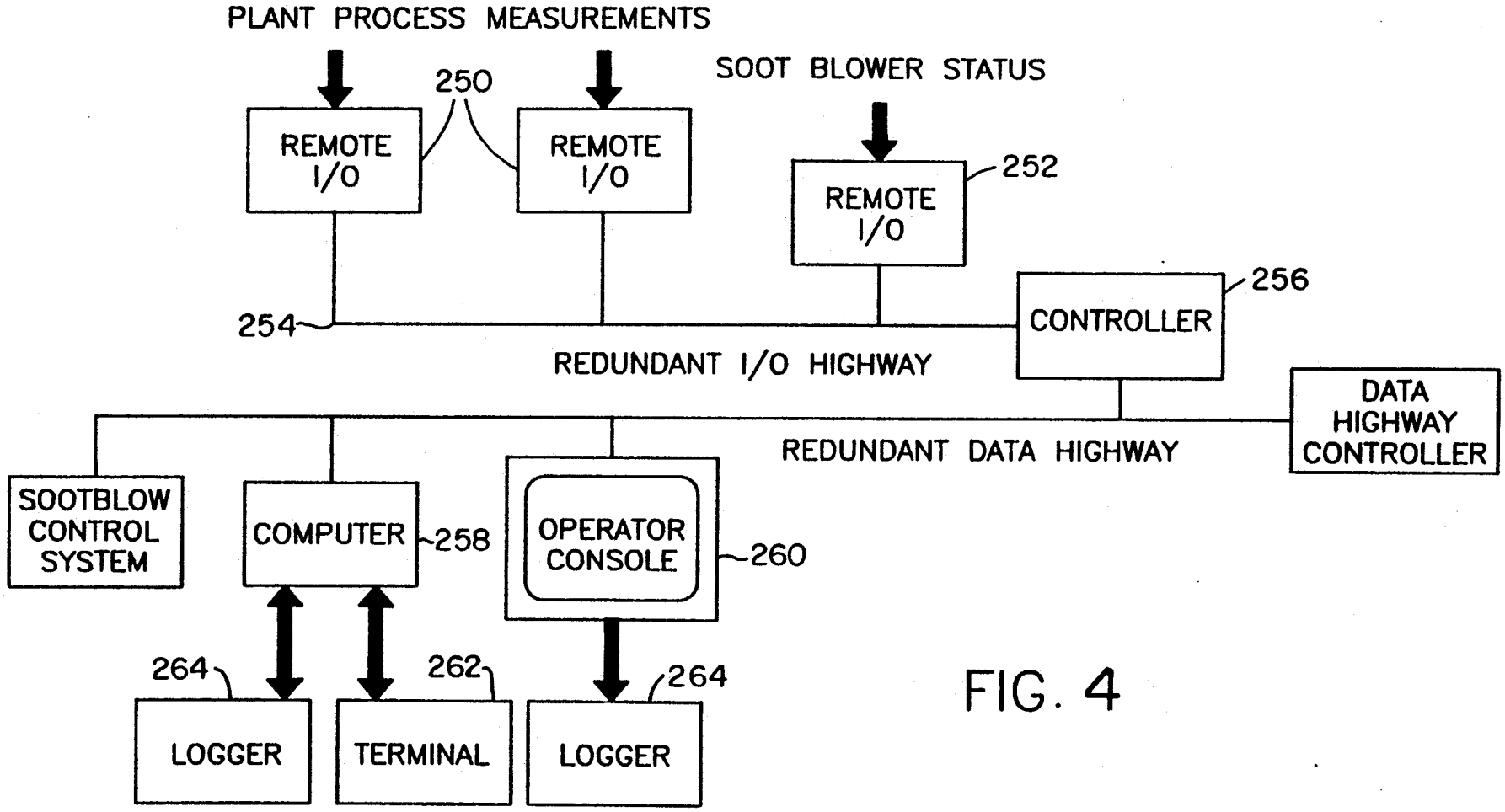
FIG. 4 is a schematic of the general hardware configuration used to implement the invention.

As seen in FIG. 4, the distributed control system hardware configuration is comprised of conventional remote input-output registers 250 that receive data from the system sensor, an input-output highway 254, a controller 256, a computer 258 and an operator console 260. The computer 258 interfaces with a terminal 262 and is provided with a custom logger 264.

Unit testing is performed, during which time readings are taken of boiler control values of flow, pressure, temperature, valve and damper positions in addition to emission readings of the production of $NO_x$, $O_2$, CO, unburned carbon and fuel. This information is received from sensors and dampers located throughout the boiler as described above. The sensors and dampers are connected to a data acquisition system such as the distributed control system (DCS). The various input variables are loaded into a custom logging program which is designed into the DCS to insure a complete database.

In addition to the basic readings which are recorded, numerous tests at various loads are performed to determine the effects that controllable combustion parameters have on $NO_x$ production.

The tests that are performed are as follows:

1. Auxiliary air damper calibration
2. Fuel air damper calibration
3. Stoichiometric ratio control
4. Fuel concentration
5. Burner tilt
6. Excess air
7. Primary air temperature
8. Glycol air preheater
9. Intermediate and low unit load.

The auxiliary air damper calibration test calibrates the effects of requested changes in auxiliary air damper control with flow distribution through the dampers and gauges the effects on emissions. This test provides a measure of the operability of the auxiliary air dampers.

In this test, the control signal for each row of auxiliary dampers is individually stepped from fully closed to wide open, provided there are no adverse effects to the burner operation. Steps of 10% increments are performed. Since the furnace air controls modulate the dampers to maintain total air flow, the primary effect of damper position changes is on furnace/windbox pressure drop predictions. Based on the change in this pressure drop, the flow through the row of auxiliary dampers is estimated and the change in flow with damper position is correlated. By repeating this test for each row of auxiliary dampers, an indication of those rows which have dampers that are not properly regulating will be provided.

The objectives of the fuel air damper calibration test are the same as the auxiliary air damper test; to calibrate the effect of damper position demand on flow at each level and to identify dampers which are not operating properly.

As in the auxiliary air damper test each control is individually stepped through a range of positions. This may require that the coal feeder corresponding to the fuel air damper level be stopped prior to each test. The effect of changing fuel distribution on emissions is also noted during these tests.

The objective of the stoichiometric ratio control tests is to establish the potential benefit in reduction of emissions provided by such control. Based on the results of the prior tests, the auxiliary and fuel air dampers are adjusted to provide an estimated stoichiometric ratio at each level.

Feeder speeds are evenly biased to provide a uniform fuel input at each level. The fuel air dampers and auxiliary air dampers are adjusted to provide a uniform stoichiometric ratio at each level. If the excess air is set at 15%, the initial stoichiometric ratio is 1.15.

The overfire auxiliary air damper 350 is initially closed. The effects of changes in individual row stoichiometric ratios are determined. Each auxiliary damper control is stepped up to increase the air flow at a level by approximately 10% and then returned to the original position. This is repeated with the fuel air damper control.

The stoichiometric ratio is adjusted downwardly by approximately 10%, with the excess air channelled through the overfire auxiliary air port 350. Again, each auxiliary air and fuel air damper control is stepped up and returned individually.

This test is repeated with 10% reductions in stoichiometric ratio which may result in substoichiometric firing at each level, provided satisfactory combustion conditions are maintained. To drive all of the excess air through the overfire auxiliary air port, it may be necessary to adjust the furnace/windbox pressure differential. When it is not possible to force all this air through the overfire auxiliary air port 350, fuel air damper 364 and then an auxiliary air damper 352 can be used to meet the requirements. The sensitivity tests are repeated by stepping auxiliary and fuel air damper control demands.

The fuel concentration test demonstrates the effect of removing fuel from the upper portions of the furnace and concentrating fuel in the lower sections. Based on the results of the stoichiometric tests, a stoichiometric ratio with favorable emission characteristics for the fuel concentration test is established.

The fuel input through level A is gradually reduced, while maintaining even fuel distribution through the remaining feeders. The air dampers are not adjusted unless required for satisfactory combustion. This results in a lower stoichiometric ratio for the B-F levels. When minimum speed is reached, feeder 376 at level A is turned off if the load of the boiler permits. With the feeder 376 at level A out of service, overfire air damper 350, auxiliary air damper 352 and fuel air damper 364 all are acting as overfire air ports.

Feeder speeds are adjusted gradually to reduce the coal flow to level B as much as possible. Following a calculation of the stoichiometric ratio at each level, the auxiliary and fuel air damper controls are gradually readjusted to approximate the stoichiometric ratio at the start of the test.

To establish the effect of elevation on overfire air, the auxiliary air damper 350 and fuel air damper 364 are gradually closed and auxiliary air damper 352 is opened, while maintaining the same furnace/windbox differential pressure (DP), i.e. the same stoichiometric ratio at each burner level.

The burner tilt test determines additional emission reductions that are achieved through the regulation of burner tilts. Data indicates a strong sensitivity of emissions to burner tilt.

Test conditions are established at fuel concentration and stoichiometric ratio conditions which demonstrate low emissions during these tests. Burner tilts are stepped down at 10 degree intervals until the bottom position is obtained. Tilts are then stepped up until the uppermost position is reached. Tilts are then returned to their original positions. The time interval for each test is kept as short as possible to minimize outside influences such as fouling. Additionally, the effects on other parameters such as steam temperatures are noted.

The fuel concentration is readjusted to all six feeders in operation with near equivalent feeder speeds. The stoichiometric ratio used in the prior tests is re-established. The effects of burner tilts are investigated again by repeating the test. This helps establish the interrelationship of burner tilts with other controllable parameters.

The objective of the excess air test is to determine additional emission reductions that are achieved through the regulation of excess air. Data also indicates a strong sensitivity of emissions to excess air.

Test conditions at the conclusion of the tilt tests are used as the starting point. Burner tilts are established at the prior position and maintained. Excess $O_2$ setpoint is reduced in 0.4% increments until unacceptable CO emission levels are obtained. Excess $O_2$ levels are increased in 0.4% increments up to a level of 5%. Again, the time interval for each test is also kept as short as possible to minimize outside influences, and the effects on other parameters, such as steam temperatures, are also noted.

Test conditions are re-established at the fuel concentration and stoichiometric ratio conditions used at the start of the first tilt tests which exhibited the most favorable emission characteristics. The excess air test is repeated to obtain sensitivity information at these controllable parameter settings.

Based on the test results, the excess $O_2$ setpoint is adjusted to the most favorable value for low emissions. Additionally, burner tilt is adjusted to minimize emissions. This condition represents the $NO_x$ emissions levels achievable through the primary controllable parameters.

The objective of changing primary air temperature is to determine whether there is any further benefit to $NO_x$ reduction. Lowering the setpoint can reduce flame temperature through the addition of cooler air and more moisture in the coal.

Test conditions are maintained from the conclusion of the last test. The primary air temperature is reduced by approximately 10 degrees over a range of 50 degrees, if acceptable.

The glycol air preheater 43 increases air temperature to the furnace. The sensitivity of $NO_x$ to this temperature is tested through the regulation of the flow of hot water to the glycol air preheater 43 system.

Test conditions are maintained from the conclusion of the last test. Temperature setpoint is increased from a condition of no hot water flow to a 40 degree increase in air preheater outlet temperature in 10 degree increments.

Selected portions of this test program are rerun at an intermediate load and a low load point. At lower loads the options for fuel concentration increase as well as air distribution. The use of the lower level feeders in combination with the higher level auxiliary air ports provide favorable conditions for low $NO_x$ production. These options are explored in determining the controllable parameter settings which achieve the lowest emission levels, while maintaining satisfactory operation of the furnace.

The information generated from the testing determines the levels to which $NO_x$ emissions can be reduced. This information varies with each furnace, even with furnaces of the same type. The level of reduction is then used in an optimization calculation where the dollar values of the operating conditions and penalty or credits for predicted $NO_x$ emissions are weighted and compared to establish the net value of controlling $NO_x$ emissions.

The model is developed and formatted as the model developed for soot blower efficiency as described in related application Labbe et al., Ser. No. 07/807,445 filed Dec. 13, 1991, U.S. Pat. No. 5,181,482 incorporated herein by reference.

The test data serves as the basis for customizing and validating a base model design. The model varies for each furnace because each furnace has unique characteristics which affect the production of $NO_x$ emissions. The model verifies the relationship between auxiliary air damper positions and auxiliary air flow to the furnace, fuel damper position and fuel air flow, and coal feeder speed and coal flow to the burners. Approximate relationships between the reducing environment on corrosion, slag formation, unburned carbon, flame instability and other adverse factors are made.

The model is a combination of multiple model programs which influence the optimum settings for the combustion parameters to reduce the production of $NO_x$ emissions. The model provides the boiler operator with information for the adjustment of controllable combustion parameters to achieve $NO_x$ reductions while maintaining satisfactory furnace performance. Because of the numerous adjustments that may be needed to the combustion controllable parameters, semi-automatic control of the parameters is also available. The $NO_x$ system can adjust the air dampers automatically following an operator initiated change in a parameter influencing combustion. Through the application of this semi-automatic control, the obligations placed on the operator to optimize $NO_x$ emissions are limited to the following:

1. Adjustment of feeder speed bias following load changes;
2. Placing mills in and out-of-service following larger load changes;
3. Changing the $O_2$ setpoint following large load changes; and
4. Possible adjustment of primary air and stack temperature setpoint.

This approach places minimal requirements on the operator, yet achieves the objective of consistency in the regulation of $NO_x$.

The $NO_x$ model is comprised of the following models:

1. Auxiliary air and fuel air damper model
2. Fuel concentration model
3. Stoichiometric ratio model
4. Excess $O_2$ model
5. Burner tilt model
6. Primary air model
7. Glycol air preheater model The objective of the auxiliary air and fuel air damper model, also known as the furnace air path model, is to relate damper position demand with air flows and furnace/windbox DP. The air path model is verified with the plant data obtained in testing.

Through the sequence of testing, the relationship between damper position demand and change in air flow through the levels is readily determined. The data also provides an indication of dampers which are not properly modulating. An estimate of the local combustion conditions for the modulating dampers is developed in terms of percentage above stoichiometric or substoichiometric.

The model predicts the damper position requirements to provide the flow distribution and furnace/windbox DP required.

The fuel concentration model determines the optimum feeder speed conditions to meet the load requirement and minimizes $NO_x$ formation. The test data obtained is the primary basis for this model.

Figure 5:
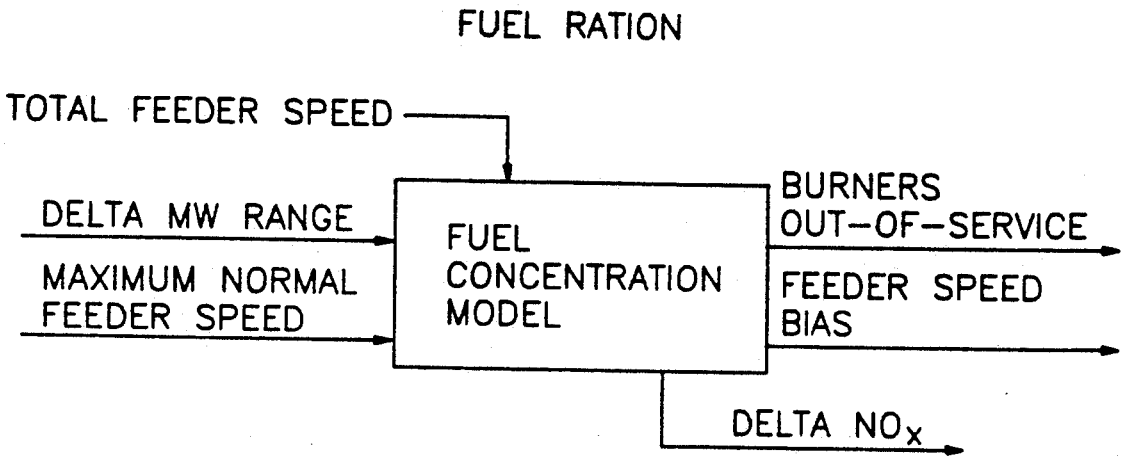
FIG. 5 is a schematic of the fuel concentration model.
Figure 6:
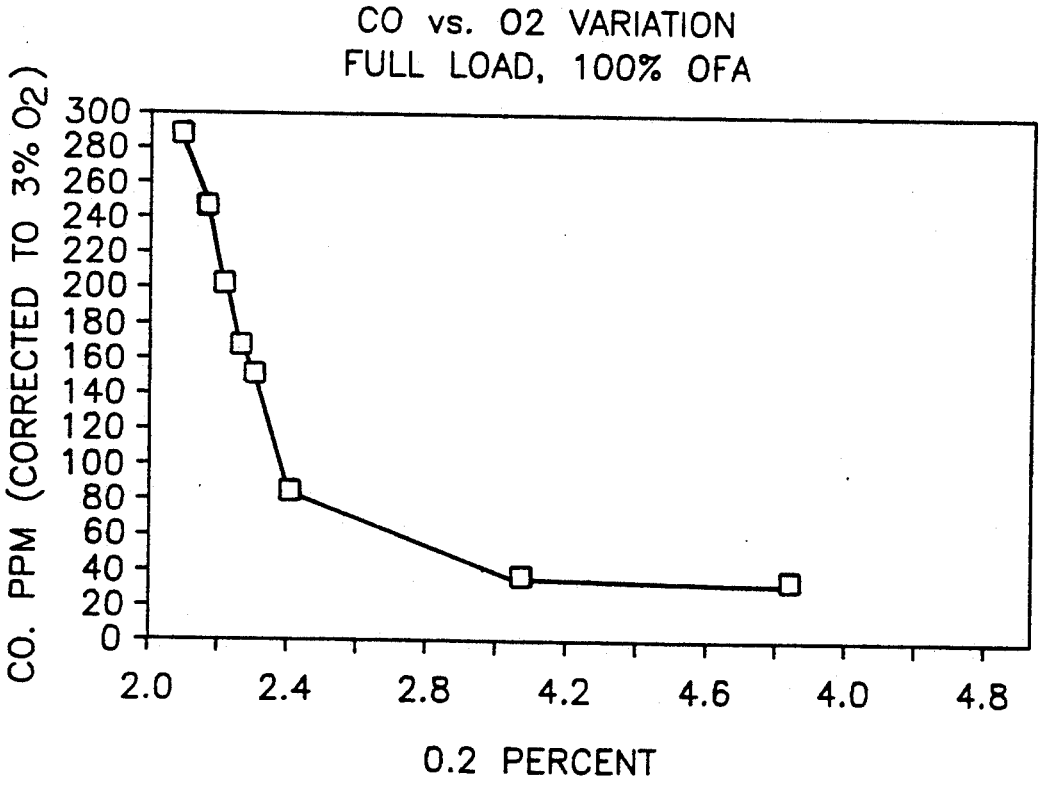
FIG. 6 is a graph of the relationship between CO versus $O_2$ variation.

A schematic of the fuel concentration model is presented in FIG. 5. The input to the model includes the current feeder speeds and feeder speed control biases.

Several engineering constraints are also input including the delta MW range that provides for fast maneuvering capability and the high limit on normal feeder speed. The output of the fuel concentration model is a recommendation on the biasing of the feeder speeds and which feeders to place out-of-service, if any. Also, the reduction in $NO_x$ that can be achieved through the recommended action is determined.

The engineering constraints are adjustable by the boiler operator or engineer through the DCS. The delta MW range essentially defines the desired load increase that can be obtained without the requirement of a feeder placed in service and with the operating feeders remaining below the high limit on normal feeder speed. There are four values for the delta MW range:

1. Feeder out-of-service delta (e.g. 20 MW)
2. Mill out-of-service delta (e.g. 25 MW)
3. Mill in service delta (e.g. 5 MW)
4. Feeder in service delta (e.g. 1 MW).

When a feeder is removed from service, the mill is maintained in service until load is reduced further due to the longer time required to start a mill. On a load increase, the mill is started prior to the actual need for the feeder. To prevent needless starting and stopping of equipment, there is a large overlap in these delta MW out-of-service and in service values as illustrated in the example values.

This approach provides a consistent means for establishing feeder speed bias and feeders out-of-service that can achieve reduced $NO_x$ production.

Additionally, the determination of equipment failure or gradual degradation is presented to the operator. A technique of small perturbations of on-line controllable combustion parameters is used to identify $NO_x$ sensitivities. Built in logic is also used to determine and identify the probable cause, thereby enabling remedial action to be suggested.

The stoichiometric ratio at each level is the primary measure used to calculate emissions and other factors. The stoichiometric ratio is determined by measuring the fuel and air introduced at each furnace level and relating the ratio of air to the theoretical requirement of air to completely combust the measured fuel flow. The model determines the air flow at each level of the furnace which provides the desired stoichiometric ratio. By maintaining a regulation of the stoichiometric ratio at each row, the production of $NO_x$ will be regulated.

Figures 7, 8:
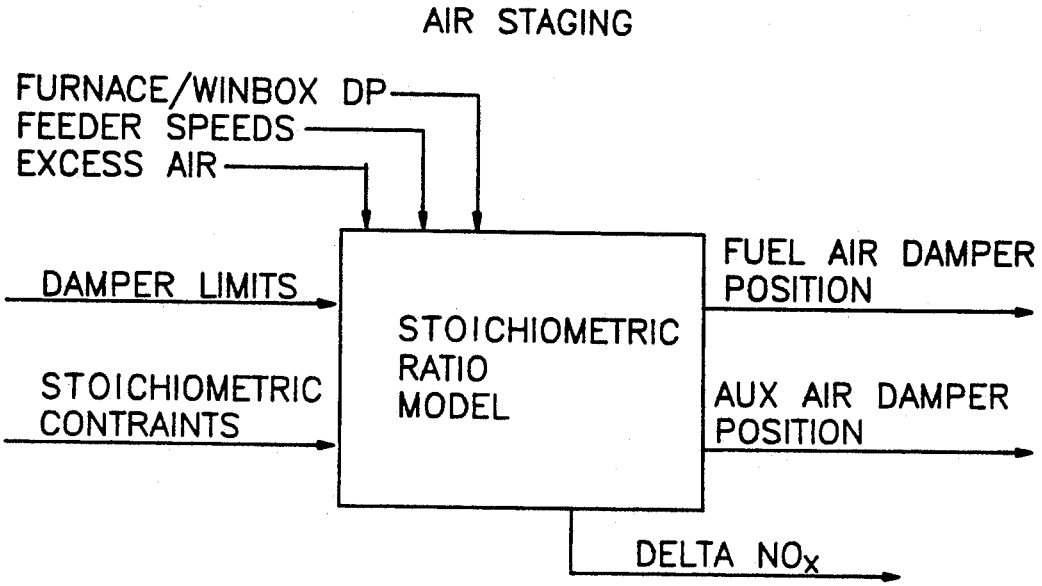
FIG. 7 is a schematic of the stoichiometric ratio model.
FIG. 8 is a screen display of recommendations for feeders and air dampers.

A schematic of the stoichiometric ratio model is presented in FIG. 7. The inputs to the model include furnace/windbox DP, feeder speeds and excess air. Engineering constraints are supplied for stoichiometric ratio and damper position limits. The model calculates the optimum fuel air and auxiliary air damper positions to achieve the lowest $NO_x$ levels consistent with the constraints. Additionally, the reduction in $NO_x$ emissions are determined.

The calculation of damper positions are governed by the feeder speed bias at each level, the desired stoichiometric ratio, the excess air control setpoint and the furnace/windbox differential pressure setpoint. In this way the air dampers do not modulate continuously, but only when the operator makes a change in the system which affects stoichiometric ratio, such as a readjustment of feeder speed bias. FIG. 8 illustrates an example of a screen display recommendation for feeders and air dampers.

A typical boiler has several auxiliary air damper controls and fuel air damper controls. Since a change in feeder speed bias or other input parameters impacting stoichiometric ratios occur frequently, manual adjustment of the damper controls may be burdensome to the operator. Consequently, the damper positions may be changed automatically, when a change in the inputs is sensed or upon the operator's initiation.

Figure 9:
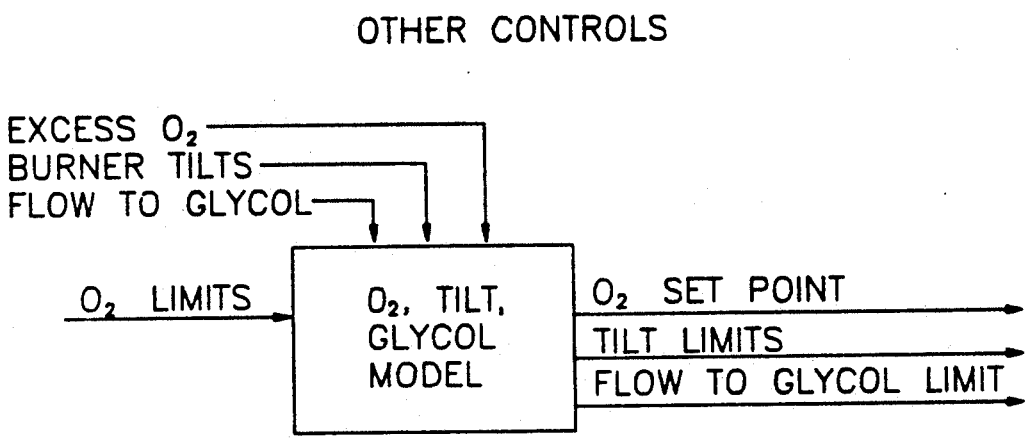
FIG. 9 is a schematic of the Burner Tilt, Excess $O_2$ and Glycol Air Preheater Model.

The excess $O_2$ model determines the optimum setpoint for the excess air control to minimize $NO_x$ and maintain satisfactory CO and unburned carbon levels. Lower excess $O_2$ further reduces $NO_x$ formation. However, the minimum required $O_2$ varies with plant loads and other conditions. The $O_2$ model determines the optimum value based on plant conditions. The model is illustrated in FIG. 9.

The burner tilt model defines the acceptable range of burner tilt operation and predicts the consequences of unacceptable operation in terms of increased $NO_x$ production. The model is based on the emissions data obtained during burner tilt tests.

Past experience indicates that burner tilt position has a strong effect on $NO_x$ production. The range of tilt operation which reduces $NO_x$ emissions most significantly are established as the preferred control range. The inputs and outputs from the tilt model are illustrated in FIG. 9.

Figure 10:
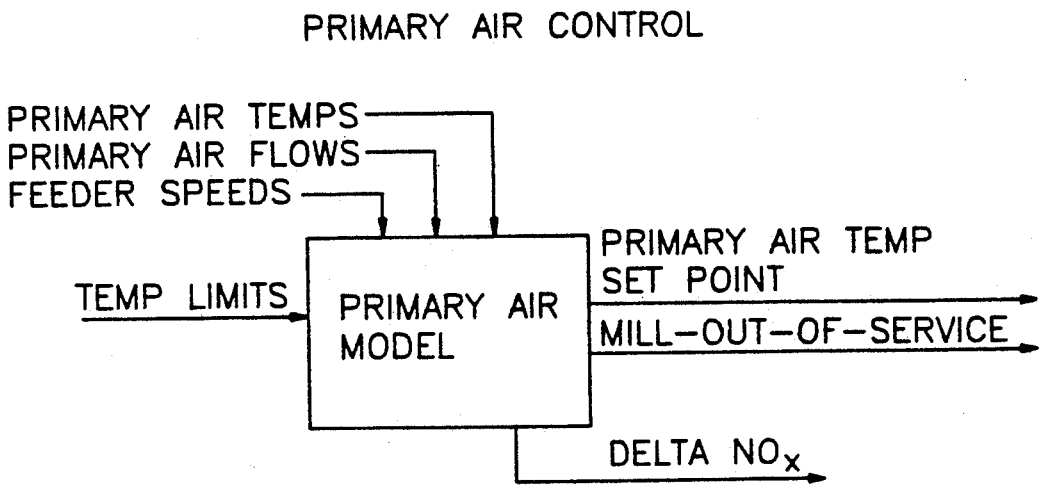
FIG. 10 is a schematic of the Primary Air Model.

The primary air model provides operator direction on the selection of primary temperature setpoint. Based on testing, primary air temperature is a means to further reduce $NO_x$ production. This model includes such effects and provides predictions of the $NO_x$ effects. The primary air model is illustrated in FIG. 10.

The glycol air preheater $NO_x$ model provides boiler operator directions on the utilization of the glycol air preheater with respect to $NO_x$ emissions and stack temperature. Cooler inlet air temperatures may reduce $NO_x$ formation, but can also result in cold end corrosion problems in the stack. This model is used to auctioneer between the two trade-offs.

The results of these models are incorporated into a decision function which determines the effect a change in a controllable parameter will have on $NO_x$ emissions as well as the effect the change will have on other controllable parameters.

The model has two modes of operation—Advisor and Controller. The Advisor calculates the effect a specific change input by the operator will have on $NO_x$ production as well as on other controllable parameters. To calculate the effect that a change in a controllable parameter will have, first the model predicts the emissions and other factors for the current settings of controllable parameters. Then the calculation is repeated with a change in the particular controllable parameter. The difference in the calculated emissions and other factors is determined and made available to the operator.

The Controller mode takes the Advisor mode one step further. The Controller determines the optimal settings for the controllable parameters that achieve minimal $NO_x$ emissions while maintaining acceptable levels of other emissions and other factors which have adverse consequences to a furnace. An optimum operator action is determined by assigning weighted cost functions based on economic and other consequences to the controllable parameters and varying the controllable parameters within constraints seeking a minimum in a cost function of the parameters.

The following is a sample of controllable parameters which the model will determine based on information received from the sensors and dampers. The model predicts the stoichiometric ratio at each burner level, $NO_x$ produced at each burner level, as well as overall plant $NO_x$ production, the fuel entering the combustion section and the amount of CO produce, from the temperature of the air entering the combustion section, the percentage of $O_2$ in the exhaust gas, the position of the tilt, the position of the overfire air dampers, the position of the underfire air dampers, the feeder speed at each burner level, the position of the fuel air dampers at each burner level, the position of the auxiliary air dampers at each burner level, and the windbox to furnace pressure drop.

After the model is developed, the model predictions are compared to actual values received from the sensors and dampers to determine the accuracy of the model. The model is operational after the accuracy of the model has been established.

An illustration of the $NO_x$ Emission Advisor and Control system follows. In implementing step one, unit testing data is collected from the various sensors and dampers. The following are examples of readings received from various sensors and dampers that are located throughout the furnace at a particular time. The generator sensor 112 read 533 MW; the feed water flow was 3330 KLB/HR; the SH out temperature left side read 1002° F. and the right side read 1000° F.; the fuel nozzle tilts left side was 7° and right side was −20°; the $NO_x$ level was 579 PPM and 0.88 LB/MBTU; the CO level was 9 PPM and 0.01 LB/MBTU; the $O_2$ was 4.7%; and the windbox to furnace DP was 5.50 in $H_2O$. The fuel and air dampers were in the following positions: overfire air damper 350 was open 47%; auxiliary air damper 352 was open 50%; auxiliary air damper 354 was open 54%; auxiliary air damper 356 was open 54%; auxiliary air damper 358 was open 51%; auxiliary air damper 360 was open 53%; and auxiliary air damper 362 was open 100%; fuel air damper 364 was open 100%; fuel air damper 366 was open 99%; fuel air damper 368 was open 100%; fuel air damper 370 was open 100%; fuel air damper 372 was open 87% and fuel air damper 374 was open 100%.

Table 1 shows sample readings received from the sensors and dampers as a result of performing $NO_x$ tests.

TABLE 1

TEST DATA AND RESULTS

| | | TEST NUMBER | | | | | |
|---|---|---|---|---|---|---|---|
| | | 1 | 2 | 3 | 4 | 5 | 6 |
| | | PURPOSE OF TEST | | | | | |
| | | NORMAL | FF/AA | O2 VARIATION | | TILT VARIATION | |
| CONTROL | MIN | OPER | 100% | 6.3% O2 | 3.8% O2 | +14 DEG | −14 DEG |
| DATE | 1991 | 4-16 | 4-17 | 4-16 | 4-16 | 4-16 | 4-17 |
| START TIME | HRS | 1045 | 1015 | 1300 | 1515 | 845 | 800 |
| STOP TIME | HRS | 1145 | 1115 | 1400 | 1030 | 0930 | 0915 |
| GENERATION | MW | 533 | 530 | 528 | 532 | 530 | 531 |
| FEED WATER FLOW | KLB/HR | 3330 | 3375 | 3340 | 3360 | 3340 | 3360 |
| SHOUT TEMP LEFT | DEGF | 1002 | 1001 | 1001 | 1001 | 1002 | 996 |
| SHOUT TEMP RIGHT | DEGF | 1000 | 1001 | 1000 | 1010 | 1001 | 1002 |
| FUEL NOZZLE TILTS LEFT | DEG | +7 | −1 | +18 | +10 | +14 | −14 |
| FUEL NOZZLE TILTS RIGHT | DEG | −20 | −1 | +21 | −14 | +14 | −15 |
| GAS ANALYSIS ECONOMIZER OUTLET | | | | | | | |
| $NO_x$ | PPM | 579 | 514 | 501 | 506 | 527 | 556 |
| CO | PPM | 9 | 12 | 13 | 25 | 12 | 10 |
| O2 | % | 4.7 | 4.3 | 6.3 | 3.6 | 5.5 | 4.3 |
| $NO_x$ CORR TO 3% O2 | PPM | 640 | 557 | 613 | 530 | 613 | 598 |
| COCORR TO 3% O2 | PPM | 10 | 13 | 16 | 28 | 14 | 11 |
| $NO_x$ | LB/MBTU | 0.88 | 0.75 | 0.83 | 0.72 | 0.84 | 0.82 |
| CO | LB/MBTU | 0.01 | 0.02 | 0.02 | 0.03 | 0.02 | 0.01 |
| F FACTOR | DSCF/MBTU | 9833 | 9773 | 9647 | 9808 | 9848 | 9837 |
| WINDBOX TO FURN DP- | INH2O | 5.50 | 4.25 | 5.60 | 5.55 | 5.53 | 5.50 |
| FUEL AIR/AUX AIR DAMPERS | | | | | | | |
| AUX AA | % OPEN | 47 | 100 | 68 | 43 | 57 | 38 |
| FUEL A | % OPEN | 100 | 100 | 100 | 88 | 100 | 76 |
| AUX AB | % OPEN | 50 | 98 | 72 | 43 | 61 | 55 |
| FUEL B | % OPEN | 99 | 100 | 100 | 76 | 100 | 100 |
| AUX BC | % OPEN | 54 | 100 | 77 | 40 | 62 | 53 |
| FUEL C | % OPEN | 100 | 100 | 100 | 85 | 100 | 100 |
| AUX CD | % OPEN | 54 | 100 | 77 | 40 | 62 | 53 |
| FUEL D | % OPEN | 100 | 100 | 100 | 71 | 100 | 100 |
| AUX DE | % OPEN | 51 | 100 | 72 | 37 | 61 | 55 |
| FUEL E | % OPEN | 87 | 100 | 100 | 66 | 100 | 100 |
| AUX EF | % OPEN | 53 | 100 | 72 | 35 | 61 | 59 |
| FUEL F | % OPEN | 100 | 100 | 100 | 72 | 100 | 100 |
| AUX FF | % OPEN | 100 | 100 | 100 | 100 | 100 | 100 |

| | | TEST NUMBER | | | | |
|---|---|---|---|---|---|---|
| | | 7A | 7B | 7C | 8 | 9 |
| | | PURPOSE OF TEST | | | | |
| | | OFA SIMULATIONS | | | 386 | 250 |
| CONTROL | MIN | FF/AA VARIATIONS | | | MW | MW |
| DATE | 1991 | 4-17 | 4-17 | 4-17 | 4-18 | 4-18 |
| START TIME | HRS | 1345 | 1615 | 1700 | 0015 | 0215 |
| STOP TIME | HRS | 1615 | 1645 | 1715 | 0107 | 0305 |

TABLE 1-continued

| TEST DATA AND RESULTS | | | | | | |
|---|---|---|---|---|---|---|
| GENERATION | MW | 528 | 528 | 527 | 386 | 250 |
| FEED WATER FLOW | KLB/HR | 3395 | 3395 | 3370 | 2350 | 1670 |
| SHOUT TEMP LEFT | DEGF | 1000 | 998 | 1001 | 1005 | 933 |
| SHOUT TEMP RIGHT | DEGF | 999 | 1000 | 1000 | 1006 | 935 |
| FUEL NOZZLE TILTS LEFT | DEG | −1 | −1 | −1 | +25 | −3 |
| FUEL NOZZLE TILTS RIGHT | DEG | −1 | −1 | −1 | +32 | +8 |
| GAS ANALYSIS ECONOMIZER OUTLET | | | | | | |
| $NO_x$ | PPM | 458 | 491 | 443 | 470 | 330 |
| CO | PPM | 14 | 14 | 14 | 11 | 7 |
| O2 | % | 4.8 | 4.8 | 4.5 | 5.4 | 5.0 |
| $NO_x$ CORR TO 3% O2 | PPM | 508 | 547 | 497 | 543 | 372 |
| COCORR TO 3% O2 | PPM | 16 | 16 | 16 | 13 | 8 |
| $NO_x$ | LB/MBTU | 0.70 | 0.75 | 0.66 | 0.74 | 0.51 |
| CO | LB/MBTU | 0.02 | 0.02 | 0.02 | 0.02 | 0.01 |
| F FACTOR | DSCF/MBTU | 9818 | 9818 | 9818 | 9793 | 9864 |
| WINDBOX TO FURN DP- | INH2O | 5.80 | 5.60 | 5.90 | 5.00 | 3.00 |
| FUEL AIR/AUX AIR DAMPERS | | | | | | |
| AUX AA | % OPEN | 100 | 100 | 100 | 12 | 5 |
| FUEL A | % OPEN | 100 | 100 | 100 | 19 | 10 |
| AUX AB | % OPEN | 100 | 51 | 96 | 31 | 8 |
| FUEL B | % OPEN | 25 | 40 | 30 | 25 | 10 |
| AUX BC | % OPEN | 60 | 76 | 88 | 37 | 9 |
| FUEL C | % OPEN | 25 | 42 | 32 | 25 | 25 |
| AUX CD | % OPEN | 58 | 72 | 56 | 38 | 19 |
| FUEL D | % OPEN | 25 | 47 | 32 | 25 | 25 |
| AUX DE | % OPEN | 58 | 73 | 56 | 37 | 19 |
| FUEL E | % OPEN | 25 | 38 | 31 | 25 | 25 |
| AUX EF | % OPEN | 65 | 81 | 58 | 37 | 19 |
| FUEL F | % OPEN | 25 | 41 | 32 | 25 | 25 |
| AUX FF | % OPEN | 100 | 100 | 100 | 100 | 100 |

These results are reviewed to determine which controllable parameters have an effect on $NO_x$ emissions and the amount of fluctuation that occurs in the level of $NO_x$ emissions. An optimization calculation is then performed in which the weighted values of the fluctuations are determined. This information demonstrated the effects of fuel and air at each burner level in reducing $NO_x$ emissions in this specific furnace.

Thus, a model was developed which predicts the production of $NO_x$ based on the fuel and air at each burner level. This model is later used to determine the best settings for fuel and air at each burner level for lowest $NO_x$ production. The model determines the stoichiometric ratio and at each burner level, ZSTWB (1-6), $NO_x$ produced at each burner level, ZNOWB (1-6), as well as overall plant $NO_x$ production, NO, the pressure drop predictions between the windbox and furnace, DP, the amount of excess $O_2$, O2, and the amount of CO produced, CO, based on the fuel entering the combustion section, WCBFE, the temperature of the air entering the combustion section, TCBAE, the percentage of $O_2$ in the exhaust gas, EO2, the valve or damper position to the tilt, YTILT, the position of the overfire air damper, YWBOA, the position of the underfire air damper, YWBUA, the feeder speed at each burner level relative to rated, YWBFS (1-6), the position of the fuel air dampers at each burner level, YWBFA (1-6), the position of the auxiliary air dampers at each burner level, YWBAA (1-6).

Table 2 lists determinations from a model based on the input variables measured during the actual test reported in Table 1.

TABLE 2

ICASE
WCBFE, TCBAE, EO2, YTILT, YWBOA, YWBUA

TABLE 2-continued

YWBFS(1-6)
YWBFA(1-6)
YWBAA(1-6)
ZSTWB(1-6)
ZNOWB(1-6)
NO, DP, O2, CO

| | | | | | |
|---|---|---|---|---|---|
| 1 | | | | | |
| 123.5000 | 560.0000 | 4.7000 | .0000 | 4.7863 | 100.0000 |
| .4700 | .4900 | .5300 | .5000 | .4300 | .5700 |
| 100.0000 | 99.6689 | 100.0000 | 100.0000 | 95.5084 | 100.0000 |
| 77.9457 | 79.5536 | 81.6000 | 81.6000 | 80.0752 | 81.0982 |
| 1.3261 | 1.3445 | 1.3817 | 1.4744 | 1.6182 | 1.8279 |
| .7342 | .7488 | .7744 | .8210 | .8615 | .8865 |
| .8056 | 5.6557 | 32.6119 | 30.0004 | | |
| 2 | | | | | |
| 123.5000 | 560.0000 | 4.3000 | .0000 | 4.7863 | 100.0000 |
| .4300 | .4900 | .5000 | .5160 | .4800 | .5800 |
| 100.0000 | 100.0000 | 100.0000 | 100.0000 | 100.0000 | 100.0000 |
| 100.0000 | 99.3355 | 100.0000 | 100.0000 | 100.0000 | 100.0000 |
| 1.2912 | 1.2813 | 1.3052 | 1.3509 | 1.4607 | 1.6685 |
| .7025 | .6925 | .7159 | .7535 | .8154 | .8701 |
| .7624 | 4.1524 | 29.1175 | 30.0036 | | |
| 3 | | | | | |
| 123.5000 | 560.0000 | 6.3000 | .0000 | 4.7863 | 100.0000 |
| .5000 | .5000 | .5400 | .5100 | .4300 | .5200 |
| 100.0000 | 100.0000 | 100.0000 | 100.0000 | 100.0000 | 100.0000 |
| 88.0497 | 89.7263 | 91.7365 | 91.7365 | 89.7263 | 89.7263 |
| 1.4850 | 1.5205 | 1.5698 | 1.6906 | 1.8917 | 2.1833 |
| .8251 | .8373 | .8510 | .8732 | .8902 | .8977 |
| .8619 | 6.1991 | 48.5044 | 30.0000 | | |
| 4 | | | | | |
| 123.5000 | 560.0000 | 3.8000 | .0000 | 4.7863 | 100.0000 |
| .5600 | .5000 | .5400 | .4700 | .4300 | .5000 |
| 95.8692 | 91.3416 | 94.7782 | 89.3131 | 87.1866 | 89.7263 |
| 75.6911 | 75.6911 | 73.9060 | 73.9060 | 72.0289 | 70.7200 |
| 1.2498 | 1.3038 | 1.3525 | 1.4761 | 1.6363 | 1.9810 |
| .6571 | .7146 | .7546 | .8217 | .8648 | .8937 |
| .7792 | 5.8344 | 24.9793 | 30.0572 | | |
| 5 | | | | | |
| 123.5000 | 560.000 | 5.5000 | .0000 | 4.7863 | 100.0000 |
| .4800 | .5000 | .5100 | .5100 | .4500 | .5500 |
| 100.0000 | 100.0000 | 100.0000 | 100.0000 | 100.0000 | 100.0000 |

TABLE 2-continued

| | | | | | |
|---|---|---|---|---|---|
| 83.0689 | 84.9491 | 85.4062 | 85.4062 | 84.9491 | 84.9491 |
| 1.4015 | 1.4241 | 1.4675 | 1.5483 | 1.7114 | 1.9764 |
| .7862 | .7984 | .8182 | .8454 | .8758 | .8936 |
| .8369 | 5.9162 | 40.1453 | 30.0000 | | |
| 6 | | | | | |
| 123.5000 | 560.0000 | 4.3000 | .0000 | 4.7863 | 100.0000 |
| .3700 | .5100 | .5000 | .5200 | .5000 | .6000 |
| 91.3416 | 100.0000 | 100.0000 | 100.0000 | 100.0000 | 100.0000 |
| 72.6656 | 82.0956 | 81.0982 | 81.0982 | 82.0956 | 84.0197 |
| 1.2912 | 1.2745 | 1.3064 | 1.3529 | 1.4671 | 1.7193 |
| .7025 | .6853 | .7170 | .7550 | .8181 | .8768 |
| .7652 | 5.3703 | 29.1175 | 30.0036 | | |
| 701 | | | | | |
| 123.5000 | 560.0000 | 4.8000 | .0000 | 4.7863 | 100.0000 |
| .0000 | .5000 | .4700 | .4900 | .4400 | .6000 |
| 100.0000 | 63.2878 | 63.2878 | 63.2878 | 63.2878 | 63.2878 |
| 100.0000 | 100.0000 | 84.4870 | 83.5471 | 83.5471 | 86.7484 |
| 1.3351 | 1.0986 | 1.1137 | 1.1565 | 1.2647 | 1.4351 |
| .7415 | .4093 | .4336 | .5128 | .6746 | .8039 |
| .5755 | 6.1872 | 33.5126 | 30.0002 | | |
| 702 | | | | | |
| 123.5000 | 560.0000 | 4.8000 | .0000 | 4.7863 | 100.0000 |
| .0000 | .5000 | .4700 | .4900 | .4400 | .5900 |
| 100.0000 | 73.9060 | 75.1056 | 77.9457 | 72.6656 | 74.5107 |
| 100.0000 | 80.0752 | 91.3416 | 89.7263 | 90.1356 | 93.2825 |
| 1.3351 | 1.1080 | 1.1646 | 1.2049 | 1.3070 | 1.4734 |
| .7415 | .4242 | .5282 | .5961 | .7176 | .8206 |
| .6234 | 5.7046 | 33.5126 | 30.0002 | | |
| 703 | | | | | |
| 123.5000 | 560.0000 | 4.5000 | .0000 | 4.7863 | 100.0000 |
| .0000 | .5000 | .4800 | .4900 | .4500 | .5900 |
| 100.0000 | 67.2125 | 68.6593 | 68.6593 | 67.9437 | 68.6593 |
| 100.0000 | 98.6619 | 95.8692 | 82.5852 | 82.5852 | 83.5471 |
| 1.3084 | 1.0812 | 1.1000 | 1.1216 | 1.2226 | 1.4040 |
| .7189 | .3836 | .4115 | .4470 | .6218 | .7877 |
| .5390 | 5.7071 | 30.8434 | 30.0012 | | |
| 8 | | | | | |
| 88.0000 | 540.0000 | 5.4000 | .0000 | 4.7863 | 100.0000 |
| .0000 | .4200 | .5000 | .5100 | .5100 | .5600 |
| 57.8018 | 63.2878 | 63.2878 | 63.2878 | 63.2878 | 63.2878 |
| 49.6741 | 67.9347 | 72.0289 | 72.6656 | 72.0289 | 72.0289 |
| 1.3916 | 1.2339 | 1.2429 | 1.3070 | 1.4410 | 1.8246 |
| .7805 | .6371 | .6486 | .7176 | .8066 | .8863 |
| .7462 | 4.9858 | 39.1611 | 30.0000 | | |
| 9 | | | | | |
| 60.0000 | 520.0000 | 5.0000 | .0000 | 4.7863 | 100.0000 |
| .0000 | .0000 | .2700 | .5600 | .3600 | .6100 |
| 46.7735 | 46.7735 | 63.2878 | 63.2878 | 63.2878 | 63.2878 |
| 37.2100 | 43.4350 | 45.1752 | 57.8081 | 57.8081 | 57.8081 |
| 1.3535 | 1.2102 | 1.0523 | 1.0066 | 1.1269 | 1.4682 |
| .7554 | .6040 | .3454 | .2953 | .4564 | .8185 |
| .5067 | 3.1516 | 35.3481 | 30.0001 | | |

The next part of developing the model is to determine its accuracy. Table 3 illustrates the accuracy of the model results to the actual test results relating to stoichiometric ratios at the burner levels. The comparisons for $NO_x$, NO, and furnace/windbox pressure drop, DP, for test data, T, and model, M, are listed along with the calculated stoichiometric ratios, SR, at levels A–F.

TABLE 3

| Case | 1 | 2 | 3 | 4 | 5 | 6 | 7A | 7B | 7C | 8 | 9 |
|---|---|---|---|---|---|---|---|---|---|---|---|
| SR A | 1.32 | 1.28 | 1.48 | 1.24 | 1.39 | 1.28 | 1.33 | 1.33 | 1.30 | 1.38 | 1.34 |
| SR B | 1.34 | 1.27 | 1.51 | 1.29 | 1.42 | 1.27 | 1.09 | 1.10 | 1.08 | 1.23 | 1.20 |
| SR C | 1.37 | 1.30 | 1.56 | 1.34 | 1.46 | 1.30 | 1.10 | 1.16 | 1.09 | 1.23 | 1.04 |
| SR D | 1.46 | 1.34 | 1.68 | 1.46 | 1.54 | 1.34 | 1.14 | 1.20 | 1.11 | 1.29 | 1.00 |
| SR E | 1.60 | 1.44 | 1.87 | 1.62 | 1.69 | 1.45 | 1.25 | 1.29 | 1.20 | 1.42 | 1.11 |
| SR F | 1.89 | 1.64 | 2.15 | 1.95 | 1.95 | 1.69 | 1.40 | 1.45 | 1.37 | 1.79 | 1.44 |
| NO M | .84 | .80 | .90 | .82 | .87 | .81 | .68 | .72 | .63 | .80 | .50 |
| NO T | .88 | .75 | .83 | .72 | .84 | .82 | .70 | .75 | .66 | .74 | .51 |
| DP M | 5.31 | 3.82 | 5.76 | 5.47 | 5.53 | 5.03 | 5.56 | 5.18 | 5.15 | 4.55 | 2.93 |
| DP T | 5.50 | 4.25 | 5.60 | 5.55 | 5.53 | 5.50 | 5.80 | 5.60 | 5.90 | 5.00 | 3.00 |

Once it was determined that the model was accurate and thus operational, based on the information which was input into the model, the model functions as a "control system" to determine the effects of adjusting the auxiliary air dampers and fuel air dampers and establish the optimal settings. To illustrate this process, a series of predictions are generated for operating conditions which promote lower stoichiometric ratios in the furnace. In these cases presented in Table 4 below, fuel was evenly distributed over the six mills and the fuel air and auxiliary air dampers at each level were regulated to establish the stoichiometric ratio and the furnace/windbox pressure differential. Excess $O_2$ was held at 3.8% throughout.

Case 1 represents the base case with evenly distributed air. In case 2, the level F (bottom) dampers are pinched back. In cases 3 through 6, the next levels are pinched back to the same position as F. Cases 7 through 11 represent the same sequence with a higher degree of damper closure. The results of these predictions are presented below and indicate that the best results occur if the fuel air dampers and auxiliary air dampers are pinched back to 63.2878 and 46.7735 respectively at burner levels D, E, and F of the boiler because $NO_x$ emission would only be 0.41 LB/MMBTU and furnace/windbox pressure drop would be 7.60 inches, a high, but acceptable value. If the fuel air dampers and auxiliary air dampers are pinched back to 63.2878 and 46.7735 respectively at burner levels E and F of the boiler then $NO_x$ emission would increase to 0.47 LB/MMBTU and furnace/windbox pressure drop would decrease to 6.21 inches, and if the fuel air dampers and auxiliary air dampers are pinched back to 63.2878 and 46.7735 respectively at burner levels C, D, E and F of the boiler, then $NO_x$ emission would decrease slightly to 0.40 LB/MMBTU, but furnace/windbox pressure drop would increase to 9.51 inches, an unacceptably high value. Consequently, adjustments to the fuel and auxiliary air dampers at burner levels D, E, and F of pinched back positions of 63.2878 and 46.7735 respectively would produce the least amount of $NO_x$ emission while not adversely effecting other areas of the furnace. Additionally, pinching back the fuel air dampers and auxiliary air dampers located at the lower levels of the boiler also reduces the stoichiometric ratios in the lower sections of the furnace.

TABLE 4

| | | | | | |
|---|---|---|---|---|---|
| ICASE | | | | | |
| WCBFE, TCBAE, EO2, YTILT, YWBOA, YWBUA | | | | | |
| YWBFS(1-6) | | | | | |
| YWBFA(1-6) | | | | | |
| YWBAA(1-6) | | | | | |
| ZSTWB(1-6) | | | | | |
| ZNOWB(1-6) | | | | | |
| NO, DP, O2, CO | | | | | |
| 1 | | | | | |
| 123.5000 | 560.0000 | 3.8000 | .0000 | 4.7863 | .0000 |
| .5000 | .5000 | .5000 | .5000 | .5000 | .5000 |
| 100.0000 | 100.0000 | 100.0000 | 100.0000 | 100.0000 | 100.0000 |
| 100.0000 | 100.0000 | 100.0000 | 100.0000 | 100.0000 | 100.0000 |

TABLE 4-continued

| | | | | | |
|---|---|---|---|---|---|
| 1.2427 | 1.2427 | 1.2427 | 1.2427 | 1.2427 | 1.2427 |
| .7274 | .7274 | .7274 | .7274 | .7274 | .7274 |
| .7274 | 4.3703 | 24.9793 | 30.0593 | | |
| 2 | | | | | |
| 123.5000 | 560.0000 | 3.8000 | .0000 | 4.7863 | .0000 |
| .5000 | .5000 | .5000 | .5000 | .5000 | .5000 |
| 100.0000 | 100.0000 | 100.0000 | 100.0000 | 100.0000 | 63.2878 |
| 100.0000 | 100.0000 | 100.0000 | 100.0000 | 100.0000 | 58.7949 |
| 1.2422 | 1.2244 | 1.1979 | 1.1536 | 1.0650 | .7992 |
| .7271 | .7147 | .6951 | .6594 | .5749 | .3026 |
| .6088 | 5.0119 | 24.9793 | 30.0640 | | |
| 3 | | | | | |
| 123.5000 | 560.0000 | 3.8000 | .0000 | 4.7863 | .0000 |
| .5000 | .5000 | .5000 | .5000 | .5000 | .5000 |
| 100.0000 | 100.0000 | 100.0000 | 100.0000 | 63.2878 | 63.2878 |
| 100.0000 | 100.0000 | 100.0000 | 100.0000 | 58.7949 | 58.7949 |
| 1.2416 | 1.2034 | 1.1462 | 1.0508 | .8601 | .8601 |
| .7267 | .6993 | .6531 | .5597 | .3525 | .3525 |
| .5203 | 5.8059 | 24.9793 | 30.0666 | | |
| 4 | | | | | |
| 123.5000 | 560.0000 | 3.8000 | .0000 | 4.7863 | .0000 |
| .5000 | .5000 | .5000 | .5000 | .5000 | .5000 |
| 100.0000 | 100.0000 | 100.0000 | 63.2878 | 63.2878 | 63.2878 |
| 100.0000 | 100.0000 | 100.0000 | 58.7949 | 58.7949 | 58.7949 |
| 1.2409 | 1.1789 | 1.0860 | .9312 | .9312 | .9312 |
| .7262 | .6803 | .5968 | .4210 | .4210 | .4210 |
| .4772 | 6.8047 | 24.9793 | 30.0673 | | |
| 5 | | | | | |
| 123.5000 | 560.0000 | 3.8000 | .0000 | 4.7863 | .0000 |
| .5000 | .5000 | .5000 | .5000 | .5000 | .5000 |
| 100.0000 | 100.0000 | 63.2878 | 63.2878 | 63.2878 | 63.2878 |
| 100.0000 | 100.0000 | 58.7949 | 58.7949 | 58.7949 | 58.7949 |
| 1.2401 | 1.1501 | 1.0150 | 1.0150 | 1.0150 | 1.0150 |
| .7257 | .6564 | .5184 | .5184 | .5184 | .5184 |
| .4974 | 8.0853 | 24.9793 | 30.0656 | | |
| 6 | | | | | |
| 123.5000 | 560.0000 | 3.8000 | .0000 | 4.7863 | .0000 |
| .5000 | .5000 | .5000 | .5000 | .5000 | .5000 |
| 100.0000 | 63.2878 | 63.2878 | 63.2878 | 63.2878 | 63.2878 |
| 100.0000 | 58.7949 | 58.7949 | 58.7949 | 58.7949 | 58.7949 |
| 1.2391 | 1.1155 | 1.1155 | 1.1155 | 1.1155 | 1.1155 |
| .7250 | .6254 | .6254 | .6254 | .6254 | .6254 |
| .6420 | 9.7645 | 24.9793 | 30.0624 | | |
| 7 | | | | | |
| 123.5000 | 560.0000 | 3.8000 | .0000 | 4.7863 | .0000 |
| .5000 | .5000 | .5000 | .5000 | .5000 | .5000 |
| 100.0000 | 100.0000 | 100.0000 | 100.0000 | 100.0000 | 63.2878 |
| 100.0000 | 100.0000 | 100.0000 | 100.0000 | 100.0000 | 46.7735 |
| 1.2420 | 1.2201 | 1.1873 | 1.1326 | 1.0231 | .6946 |
| .7270 | .7116 | .6869 | .6410 | .5280 | .2330 |
| .5820 | 5.1695 | 24.9793 | 30.0649 | | |
| 8 | | | | | |
| 123.5000 | 560.0000 | 3.8000 | .0000 | 4.7863 | .0000 |
| .5000 | .5000 | .5000 | .5000 | .5000 | .5000 |
| 100.0000 | 100.0000 | 100.0000 | 100.0000 | 63.2878 | 63.2878 |
| 100.0000 | 100.0000 | 100.0000 | 100.0000 | 46.7735 | 46.7735 |
| 1.2413 | 1.1933 | 1.1213 | 1.0013 | .7613 | .7613 |
| .7265 | .6916 | .6308 | .5016 | .2753 | .2753 |
| .4738 | 6.2098 | 24.9793 | 30.0682 | | |
| 9 | | | | | |
| 123.5000 | 560.0000 | 3.8000 | .0000 | 4.7863 | .0000 |
| .5000 | .5000 | .5000 | .5000 | .5000 | .5000 |
| 100.0000 | 100.0000 | 100.0000 | 63.2878 | 63.2878 | 63.2878 |
| 100.0000 | 100.0000 | 100.0000 | 46.7735 | 46.7735 | 46.7735 |
| 1.2404 | 1.1607 | 1.0413 | .8422 | .8422 | .8422 |
| .7259 | .6655 | .5490 | .3370 | .3370 | .3370 |
| .4086 | 7.5988 | 24.9793 | 30.0695 | | |
| 10 | | | | | |
| 123.5000 | 560.0000 | 3.8000 | .0000 | 4.7863 | .0000 |
| .5000 | .5000 | .5000 | .5000 | .5000 | .5000 |
| 100.0000 | 100.0000 | 63.2878 | 63.2878 | 63.2878 | 63.2878 |
| 100.0000 | 100.0000 | 46.7735 | 46.7735 | 46.7735 | 46.7735 |
| 1.2393 | 1.1205 | .9423 | .9423 | .9423 | .9423 |
| .7251 | .6300 | .4328 | .4328 | .4328 | .4328 |
| .4043 | 9.5119 | 24.9793 | 30.0687 | | |
| 11 | | | | | |
| 123.5000 | 560.0000 | 3.8000 | .0000 | 4.7863 | .0000 |
| .5000 | .5000 | .5000 | .5000 | .5000 | .5000 |
| 100.0000 | 63.2878 | 63.2878 | 63.2878 | 63.2878 | 63.2878 |
| 100.0000 | 46.7735 | 46.7735 | 46.7735 | 46.7735 | 46.7735 |
| 1.2378 | 1.0693 | 1.0693 | 1.0693 | 1.0693 | 1.0693 |
| .7241 | .5796 | .5796 | .5796 | .5796 | .5796 |

TABLE 4-continued

| | | | |
|---|---|---|---|
| .5479 | 12.2501 | 24.9793 | 30.0641 |

Through prior testing it was established that the exit gas $O_2$ could be reduced from 4.7% to 3.8% to reduce $NO_x$ without adverse effects on other furnace parameters. The predicted reduction of $NO_x$ from is 0.9056 to 0.74. The burner tilt position of 0° was determined to be satisfactory and have no adverse effect of $NO_x$.

Due to the requirement to operate the boiler at full load all of the coal mills were required to operate. The coal feeders were set evenly to provide an additional reduction from 0.74 to 0.7274.

This model based evaluation process is repeated until the settings which result in the lowest predicted $NO_x$ production while maintain acceptable windbox to furnace pressure drop are determined.

In this case the Case 9 condition is determined to result in the lowest $NO_x$ production with an acceptable windbox to furnace pressure drop. The "Advisor" then uses the model to determine the calculated difference in $NO_x$ production for the current condition, assume Case 1, and the optimum condition, Case 9 and transmits the results to the operator console. The advisor also transmits the current damper positions and the recommended positions to the operator console. These values are displayed to the operator to advise the recommended damper positions and the expected reduction in $NO_x$ and effect on windbox to furnace pressure drop.

Following operator acceptance of the damper position recommendations the "control system" transmits the damper position demands from the computer to the damper controllers via the distributed control system as follows: overfire air damper 300 to 100% open, auxiliary air damper 352 to 100%, auxiliary air damper 354 to 100%, auxiliary air damper 356 to 100%, auxiliary air damper 358 to 46.77% open, auxiliary air damper to 360 to 46.77% open, auxiliary air damper 362 to 46.77% open, underfire air damper to 0%, fuel air damper 364 to 100% open, fuel air damper 366 to 100% open, fuel air damper to 368 to 100% open, fuel air damper 370 to 63.29% open, fuel air damper 372 to 63.29% open and fuel air damper 374 to 63.29% open and feeding fuel evenly to all levels, the $NO_x$ production would be reduced to 0.41 LB/MBTU and the windbox to furnace pressure drop only increased to 7.60 inches.

Upon determining that by opening the fuel air dampers and auxiliary air dampers as previously stated a reduction in $NO_x$ emission will occur. A signal is sent from the computer 258 or from the operator's console 260 to open the dampers appropriately. This request sends a signal through the DCS or data acquisition system to the controller 256. The controller 256 then sends a signal to the remote I/O 252 which initiates an electrical circuit which changes the position of the fuel and auxiliary air dampers. Through the incorporation of the other controllable combustion parameters which effect the production of $NO_x$ emissions besides stoichiometry even lower levels of $NO_x$ production are possible.

We claim:

1. A process for controlling $NO_x$ emissions of a system which comprises a plurality of levels, said process comprising the steps of:

(a) obtaining the current status of controllable combustion parameters and the level of emissions produced from strategically located sensors;

(b) analyzing the data to determine whether the level of $NO_x$ emissions can be reduced;

(c) calculating the effect of changing various controllable combustion parameters;

(d) determining if the effect by which $NO_x$ emissions can be reduced is cost effective; and (e) developing models which calculate the effect that changing various controllable combustion parameters has on the level of $NO_x$ emissions.

2. A process as in claim 1 comprising the step of modifying the controllable combustion parameters.

3. A process as in claim 2 wherein the step of modifying the controllable combustion parameters is performed automatically through a computer.

4. A process as in claim 1 comprising the further step of displaying the effect of predicted changes compared to other changes in a graphic display.

5. A process as in claim 1 wherein the status of controllable combustion parameters and the level of emissions obtained in step (a) is entered into a custom logger.

6. A process as in claim 1 wherein the calculating of the effect of changing various controllable combustion parameters is performed by predicting the change that will occur in the system by implementing each one of many means for effecting a change serially and comparing the predicted change against current status level of $NO_x$ emissions.

7. A process as in claim 6 wherein the step of predicting each change that will occur in the level of $NO_x$ emissions is performed in a computer program.

8. A process as in claim 1 wherein the controllable combustion parameters obtained from strategically located sensors is comprised of temperature, pressure, flow, valve and damper position and generator output.

9. A process as in claim 1 wherein the emission levels obtained from strategically located sensors is comprised of $NO_x$, $CO_2$, CO, unburned carbon and fuel.

10. A process as in claim 1 wherein the system is provided with numerous fuel air dampers and auxiliary air dampers at each level in the system.

11. An apparatus for determining the level by which $NO_x$ emissions can be reduced in a system, said apparatus comprising:

(a) an assembly of sensors for obtaining the current status of controllable combustion parameters and the level of emissions;

(b) a plurality of means for changing the controllable combustion parameters in the system;

(c) a computer;

(d) a computer program within the computer for analyzing the status of controllable combustion parameters and the level of $NO_x$ emissions and calculating changes to the controllable combustion parameters which reduce the level of $NO_x$ emissions; and (e) means for delivering the status of the controllable combustion parameters and the level of $NO_x$ emissions from the sensors to the computer.

12. A process for regulating in a system comprising a plurality of burner levels the air damper positions comprising the steps of:

(a) accessing the stoichiometric ratio at each burner level by measuring the fuel and air introduced at each level and comparing the ratio of the measured air to an amount of air theoretically required to completely combust the measured fuel;

(b) accessing the feeder speed bias;

(c) accessing the excess air control setpoint;

(d) accessing the desired stoichiometric ratio;

(e) accessing the desired furnace/windbox differential pressure; and (f) ascertaining from the data obtained in steps (a) through (e) the air damper positions which yields the desired stoichiometric ratio while maintaining the desired furnace/windbox differential pressure.

13. An apparatus as in claim 11 wherein the computer program is further configured to calculate the effect of changing various controllable combustion parameters, to determine if the effect by which $NO_x$ emission can be reduced is cost effective, and to develop models which calculate the effect that changing various controllable parameters has on the level of $NO_x$ emissions.

14. An apparatus as in claim 11 wherein the controllable combustion parameters obtained from the assembly of sensors is comprised of temperature, pressure, flow, valve and damper position and generator output.

15. An apparatus as in claim 11 wherein the emission levels obtained from assembly of sensors is comprised of $NO_x$, $CO_2$, CO, unburned carbon and fuel.

* * * * *